US006069331A

United States Patent [19]

Utke

[11] Patent Number: 6,069,331

[45] Date of Patent: May 30, 2000

[54] FLOW CONTROL VERTICAL SWITCH

[76] Inventor: Gene H. Utke, 9650 SW. Marina Dr., Arcadia, Fla. 34266

[21] Appl. No.: 09/296,500

[22] Filed: Apr. 22, 1999

Related U.S. Application Data

[60] Provisional application No. 60/082,897, Apr. 24, 1998.

[51] Int. Cl.[7] ..... H01H 35/18

[52] U.S. Cl. ..... 200/84 R; 200/84 C

[58] Field of Search ..... 200/81.9 R, 81.9 M, 200/82 E, 84 R, 84 A, 84 B, 84 C; 335/205, 206, 207

[56] References Cited

U.S. PATENT DOCUMENTS

| | | | |
|---|---|---|---|
| 3,165,605 | 1/1965 | Dietz | 200/81.9 M |
| 3,635,925 | 1/1972 | Fujiwara | 200/84 C |
| 4,001,533 | 1/1977 | Conery et al. | 200/84 C |
| 4,066,858 | 1/1978 | Piper et al. | 200/84 C |
| 4,084,073 | 4/1978 | Keener | 200/84 R |
| 4,404,441 | 9/1983 | MacLaren | 200/84 C |
| 4,499,347 | 2/1985 | Richards | 200/81.9 M |
| 4,746,776 | 5/1988 | Komaniak | 200/84 R |
| 4,791,254 | 12/1988 | Polverari | 200/81.9 M |
| 5,155,311 | 10/1992 | Utke | 200/84 C |
| 5,297,939 | 3/1994 | Orth et al. | 417/40 |
| 5,562,423 | 10/1996 | Orth et al. | 417/40 |

*Primary Examiner*—J. R. Scott
*Attorney, Agent, or Firm*—Frank A. Lukasik

[57] ABSTRACT

The invention is directed to a flow control vertical switch for starting and stopping electric pump motors and being controlled by the level of a liquid using the flow of the liquid being moved to hold the switch in a switched position until the sump is depleted. The invention consists of a collar, a shaft rotatably mounted on the collar, a float arm having a magnet and a float mounted on the collar and a switch housing affixed on the collar above the magnet. A flow arm mounted on the shaft and located in the stream flow retains the magnet in switching position until the fluid stops running.

2 Claims, 3 Drawing Sheets

DETAIL A 25
13
14
20
19
26
18
17
16
15
11
32
12
23

22
14
13
DETAIL A
24
25
21

FLOW CONTROL VERTICAL SWITCH

This is a continuation-in-part of Ser. No. 60/082,897, Filed Apr. 24, 1998.

BACKGROUND OF THE INVENTION

1. Field of the Invention

The invention relates to float switches and more specifically, the invention relates to float switches which open and close an electrical circuit in response to a vertical switch installed in the discharge line from a sump pump.

2. Discussion of the Prior Art

Many different types of float switches have been developed for opening and closing an electrical circuit in response to the level of a liquid within a reservoir. Generically, float switches include a floating buoy and a means, responsive to the vertical position of the buoy, for alternately closing an electrical circuit when the float achieves a predetermined maximum height and opening the electrical circuit when the float achieves a predefined minimum height, normally open, or normally closed.

One type of available float switch is taught by U.S. Pat. No. 4,001,533 to Conery et al, which includes a sealed level control switch for sump pumps operated by a pair of weights operatively connected to the control which has a sealed nonmagnetic material housing having a downwardly open recess extending thereinto from its lower surface. A normally open microswitch having a spring control arm extending therefrom and movable downwardly to close the switch. U.S. Pat. No. 4,084,073 to Keener discloses a float type control switch having a housing, a switch in the housing and with the switch having a spring control member extending therefrom to turn the switch on and off with movement of such control member, leads connecting to the switch and extending from the housing to the power controlled circuit. An activator arm is pivotally positioned in the housing for gravity actuated pivotal movement towards and away from the switch for engaging and moving the control member to switch closed position and to release it for switch opening action.

U.S. Pat. No. 4,746,776 to Komaniak discloses a float actuated switching assembly having a pusher linked to a float, a movable carrier member, preferably a pivotable cam, having upper and lower brackets between which the pusher moves, first and second stops to limit carrier movement, a contact member on the carrier positioned to contact the stops, and magnets to releasably hold the contact against a stop as the pusher moves toward and applies initial force to one of the brackets.

U.S. Pat. No. 5,297,939 to Orth et al discloses an automatic control for bilge and sump pump comprising a permanent magnet mounted in a float that is contained within a float chamber and which has a bottom opening through which the liquid can enter the float chamber. A top portion of the float chamber is provided with a one-way valve so as to allow air to escape from the float chamber, but which prevents air from entering the float chamber such that when the float moves up with the liquid, the magnet actuates a magnetic responsive switch such as a reed switch to cause the motor to drive the pump. When the liquid level falls to the bottom of the float chamber, air rushes into the chamber and allows the retained liquid within the float chamber to fall out the bottom and the magnet bearing float falls to the bottom, which turns off the pump motor.

U.S. Pat. No. 5,562,423 to Orth et al is an improvement over (939) having a float switch which is not physically directly attached to the motor housing. This patent has two chambers, one in which a magnetically responsive reed switch is mounted and the other chamber comprises a float chamber into which water is received so that as the water rises, the float rises in the float chamber. A magnet is carried by the float, which actuates the reed switch when the float reaches a predetermined level in the float chamber.

Another type of available float switches is known as a mercury-actuated switch. Mercury-actuated float switches provide superior switching performance, however, because of environmental concerns relating to the use of mercury, alternatives to the mercury-actuated switch are being explored.

In the submersible sump pump industry there is a need for a switch to start and stop a pump, when the pump is contained in a small pump. This switch must operate in a very limited space and not swing outward like a float switch. An example of such a switch is U.S. Pat. No. 5,155,311 vertical switch. This switch works well, but is limited in its on and off differential of 1" to 8". There is a great need for a vertical switch with a larger on and off differential. The flow control vertical switch of this invention fills this need since it has an on and off differential of two inches to over twenty feet.

SUMMARY OF THE INVENTION

The invention is directed to a switch that turns a sump pump on and off and is controlled by the level of a liquid using the flow of the liquid being moved to hold the switch in a switched (operating) position. The switch is made operable with the use of a magnet to directly activate a microswitch that is enclosed in a liquid tight enclosure with the force of the magnet penetrating the non magnetic enclosure and directly operating the microswitch until the liquid flow has stopped, thus opening the switch.

BRIEF DESCRIPTION OF THE DRAWINGS

FIG. 2. is an expanded view of Detail A of FIG. 1 in an open position.

DETAILED DESCRIPTION OF THE PREFERRED EMBODIMENTS

Figure 1:
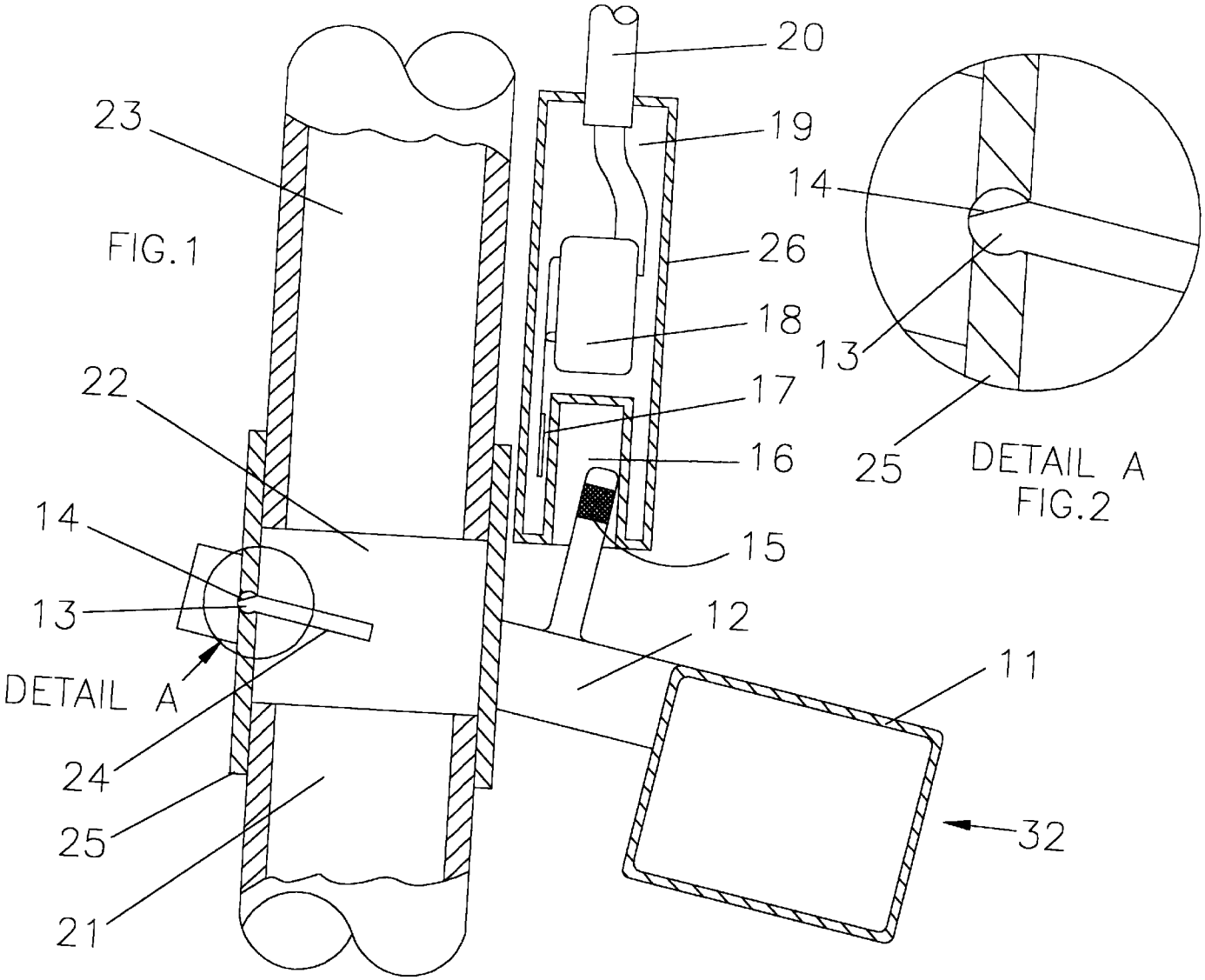
FIG. 1. is a side view, partially in section, of the flow control vertical switch in an electrically open circuit position.
Figures 3, 4:
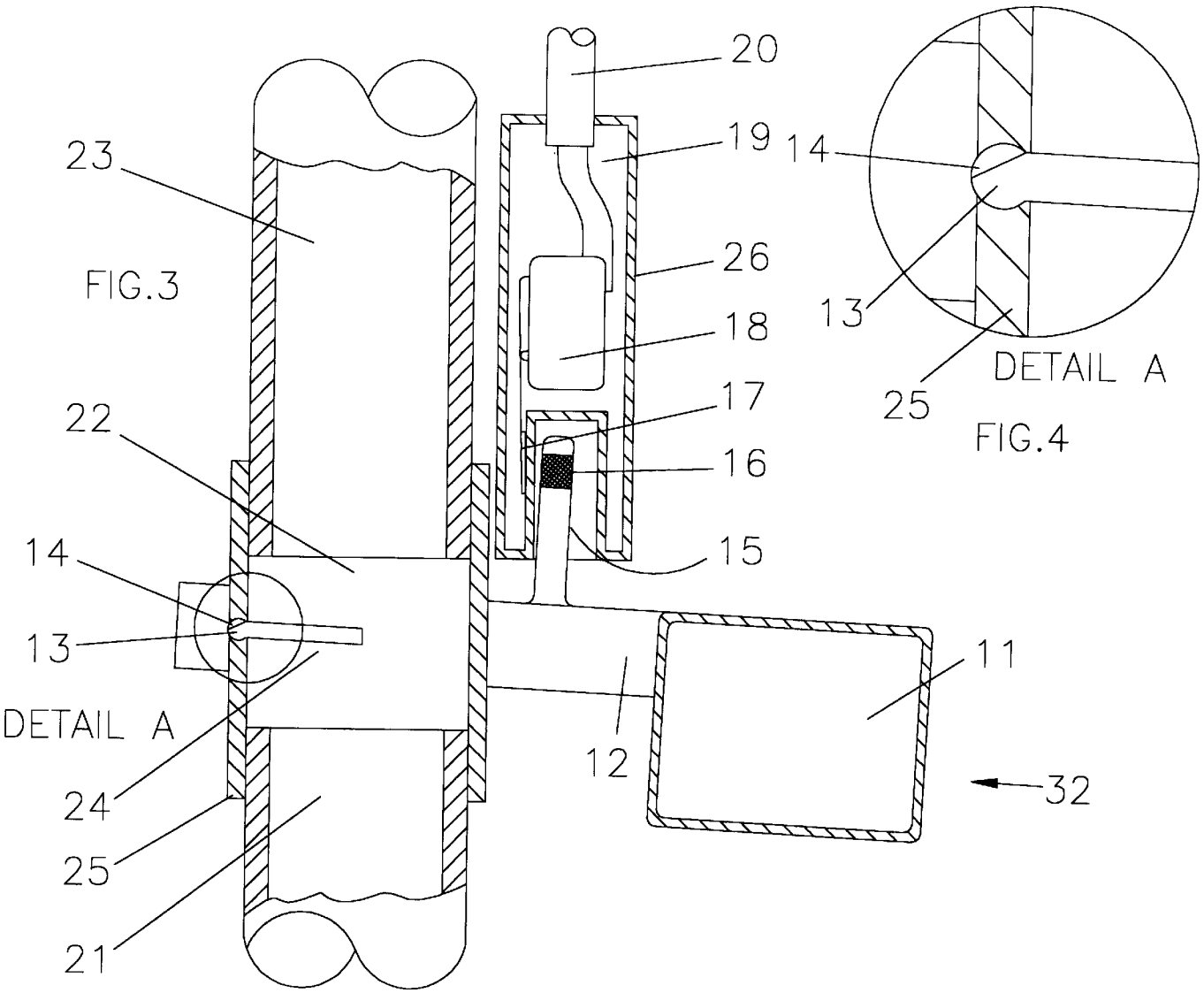
FIG. 3. is a side view, partially in section, of the flow control vertical switch in an electrically closed position FIG. 4. is an expanded view, partially in section, of detail A of FIG. 3 in a closed position.
Figure 5:
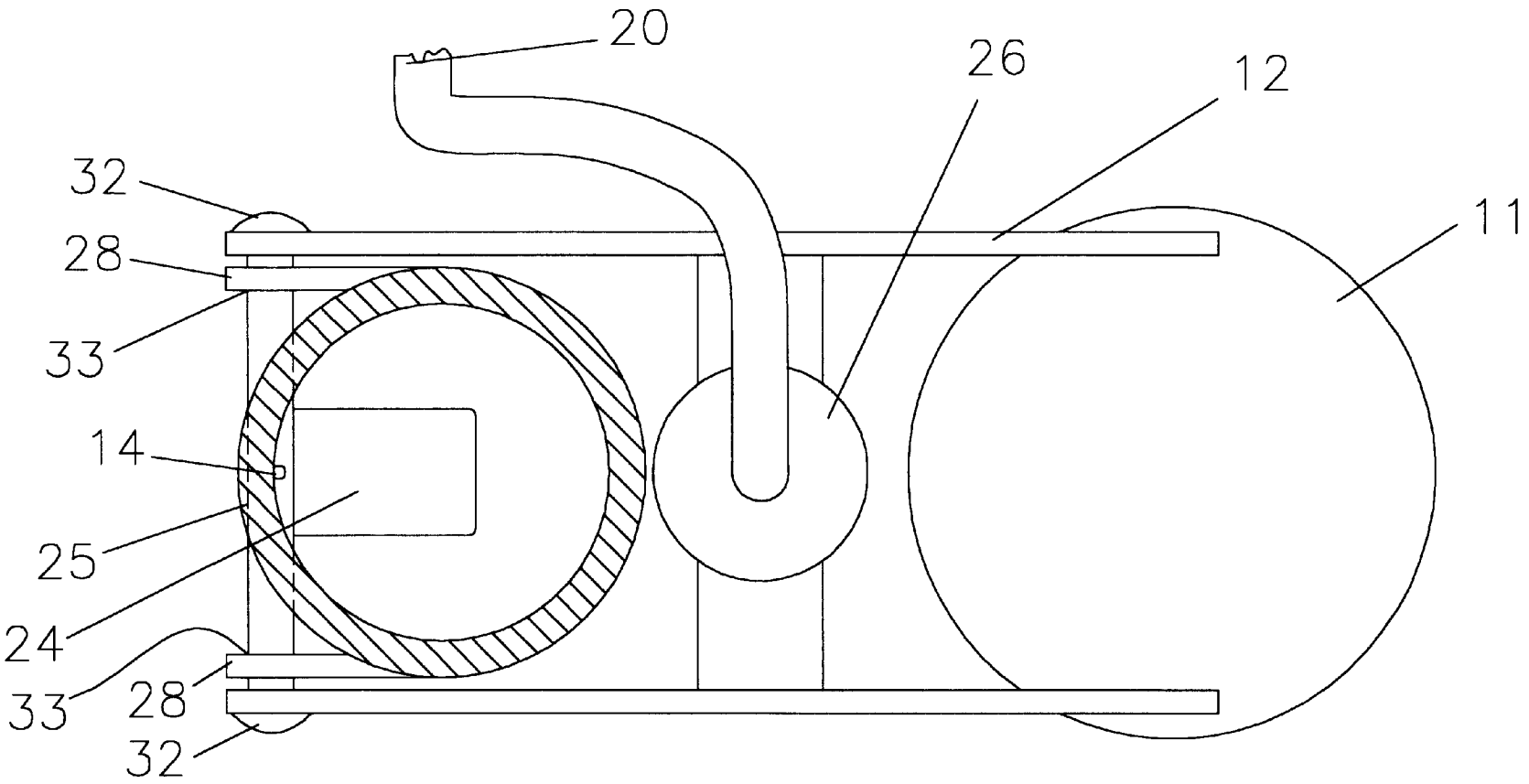
FIG. 5 is a top view, partially in section, of the flow control vertical switch in accordance with the invention.

Referring now to FIG. 1, there is shown a flow control vertical switch referred generally by the numeral 10. The flow control vertical switch 10 is installed in the discharge line 21 from the sump pump (not shown). The switch assembly 26 is fastened to the outside of collar 25 to keep the switch assembly 26 out of the flow of water.

The float arms 12 and 12' and flow arm 24 are fixedly mounted on shaft 13, which is suspended and rotates in holes 30 in extensions 28 which are attached to collar 25. Shaft 13, is fixed at each end 31 to float arms 12 and 12'. Shaft 13 also rotates in a horizontal round slot 30 formed in collar 25, which is installed between the pump discharge line 21 and the discharge line outlet 23. A hole 14, forms an orifice between the shaft 13 and the round slot 30. Flat plate 29 is mounted across float arms 12 and 12' and magnet 15 is affixed vertically on flat plate 29 and inserted within switch activation chamber 16. Switch activation chamber 16 is formed in the switch housing 26 and provides a water proof cavity within switch housing 26. The float arms 12 and 12', having flat plate 29 with magnet 15 affixed thereto, are pivoted on shaft 13, with the magnet 15 inserted within and operating within the switch activation chamber 16 by the upward motion as shown by arrow 32.

As the water rises in the sump (not shown) it also rises in the discharge line 21. A vent orifice hole 14 is formed by removing an upper portion of the shaft 13. Any air in the line 21 is vented out of vent orifice hole 14 in shaft 13. When the water rises to lift the float arm 12, it will cause the float arm 12 to rise. As the float arm 12 continues to rise, it will cause the shaft 13 to rotate and close off orifice 14, so that when the pump starts, it will not push trash into the vent orifice hole 14.

The float arm 12 will continue to rise as the float 11 rises, the magnet 15 enters the switch activation chamber 16. When the magnet 15 is in line with the micro switch arm 17, the micro switch arm 17 is pulled toward the magnet 15. This movement of the micro switch arm 17 will close the contacts in the micro switch 18 and will start the pump. As the pump starts, the water is forced through the vertical flow control switch chamber 22. The force of the water pushing up on the flow arm 24 exerts a force on the shaft 13 and holds the float arm 12 and float 11 up, even when the water falls below the float 11.

The pump will continue to remove water from the sump until it is empty and then the pump will draw air. When the air and water get to the flow arm 24, the holding force on the flow arm 24 disappears. This will cause the float arm 12 and float 11 to drop. Dropping the float arm 12 will cause the magnet 15 to leave the switch activation chamber 16 and the contacts in the micro switch 18 will open and stop the pump. The flow control vertical switch 10 will now wait for the water to rise in the sump and start the cycle again.

Thus it will be appreciated that the present invention provides a highly improved proximity switch for use particularly with submersible sump and sewage pumps. While alternative embodiments of the invention have been described, it is contemplated that other embodiments and/or modifications may be made in the present invention without departure from inventive concepts manifested by the disclosed embodiments. It is expressly intended, therefore, hat the foregoing description is illustrative only of preferred embodiments, no limiting, and that the true spirit and scope of the invention be determined by reference to the appended claims.

What is claimed is:

1. A flow control vertical switch for starting and stopping electric pump motors and being controlled by the level of a liquid using the flow of the liquid being moved to hold the switch in a switched position, said float switch consisting of:

a collar installed between the pump and a discharge line outlet, said collar having a horizontal, round slot formed therein, a pair of extensions mounted horizontally on said collar in a parallel relationship, said extensions each having a pivot formed at a first end therein, a shaft rotatably mounted within said round slot formed in said collar, said shaft having a first end and a second end, a first float arm having a first end being attached to said d shaft first end and a second float arm end being attached to said shaft second end, a flow arm affixed to said shaft and positioned for rotation within said collar, said flow arm being operated by the liquid flow, a float affixed across and under said float arms, a flat plate mounted across said float arms at a point between said float and said shaft, said flat plate having a magnet affixed vertically to said flat plate, a switch housing affixed to said collar in a position directly above said magnet, said switch housing having a switch actuation chamber formed therein, and a switch mounted in said switch housing and having a switch arm and an electric input wire, said switch arm being attracted by said magnet and said magnet being lifted by said float arm and inserted within and operating within said switch actuation chamber.

2. The flow control vertical switch recited in claim 1 wherein a vent orifice hole is formed in said shaft for removing any air contained in said collar from said collar.

* * * * *